US005971871A

United States Patent [19]

Sullivan et al.

[11] Patent Number: 5,971,871

[45] Date of Patent: Oct. 26, 1999

[54] MULTI-LAYER GOLF BALL

[75] Inventors: Michael J. Sullivan, Chicopee; Mark Binette, Ludlow; R. Dennis Nesbitt, Westfield; John Nealon, Springfield, all of Mass.

[73] Assignee: Spalding Sports Worldwide, Inc., Chicopee, Mass.

[21] Appl. No.: 09/012,788

[22] Filed: Jan. 23, 1998

Related U.S. Application Data

[63] Continuation-in-part of application No. 08/887,053, Jul. 2, 1997, Pat. No. 5,833,554, which is a continuation-in-part of application No. 08/530,851, Sep. 20, 1995, Pat. No. 5,766,098, which is a division of application No. 08/171,956, Dec. 22, 1993, Pat. No. 5,503,397, which is a continuation-in-part of application No. 07/800,198, Nov. 27, 1991, Pat. No. 5,273,287.

[51] Int. Cl.[6] ..... A63B 37/12; A63B 37/06

[52] U.S. Cl. ..... 473/373; 473/374; 473/378

[58] Field of Search ..... 473/373, 374, 473/378

[56] References Cited

U.S. PATENT DOCUMENTS 3,819,768 6/1974 Molitor .
4,201,384 5/1980 Barber .
4,863,167 9/1989 Matsuki et al. ..... 473/373
5,688,191 11/1997 Cavallaro et al. ..... 473/378 X
5,730,664 3/1998 Asakura et al. ..... 473/373

FOREIGN PATENT DOCUMENTS 192618 1/1983 New Zealand .

*Primary Examiner*—George J. Marlo
*Attorney, Agent, or Firm*—Laubscher & Laubscher

[57] ABSTRACT

A multi-layer golf bal including (a) a spherical core formed of a soft compression material (b) a mantle layer surrounding the core;

(c) a dimpled outer cover layer surrounding the mantle layer and having a different Shore D hardness than the mantle layer; and (d) at least one of the mantle and cover layers including a filler material having a weight greater than the core material to enhance the perimeter weight of the ball, the ball having an outer diameter of between 1.70 and 1.76 inches (43.2–44.7 mm) and a weight no greater than 1.62 ounces (45.93 g).

11 Claims, 3 Drawing Sheets

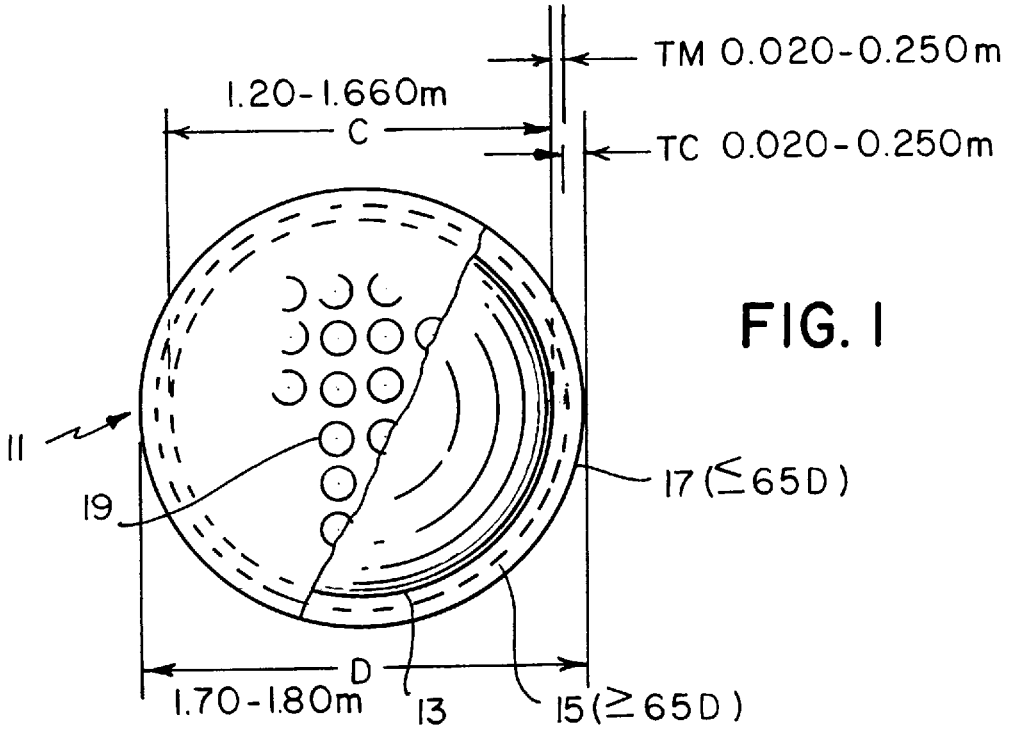
FIG. 1
FIG. 2
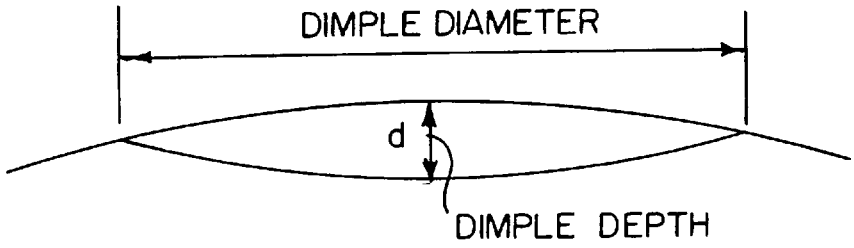

MULTI-LAYER GOLF BALL

This application is a continuation-in-part of U.S. patent application Ser. No. 08/887,053 filed Jul. 2, 1997, now U.S. Pat. No. 5,833,554 which is a continuation-in-part of U.S. Pat. application Ser. No. 08/530,851 filed Sep. 20, 1995, now U.S. Pat. No. 5,766,098 which is a division of U.S. patent application Ser. No. 08/171,956 filed Dec. 22, 1993, now U.S. Pat. No. 5,503,397 which is a continuation of U.S. patent application Ser. No. 07/800,198 filed Nov. 27, 1991, now U.S. Pat. No. 5,273,287.

BACKGROUND OF THE INVENTION

This invention relates to golf balls. In particular, it relates to a three-piece golf ball having playability characteristics which are improved relative to state-of-the-art balls.

According to United States Golf Association (U.S.G.A.) rules, a golf ball may not have a weight in excess of 1.620 ounces or a diameter smaller than 1.680 inches. The initial velocity of U.S.G.A. "regulation" balls may not exceed 250 feet per second with a maximum tolerance of 2%. Initial velocity is measured on a standard machine kept by the U.S.G.A. wherein a projection on a wheel rotating at a defined speed hits a test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a small tolerance for test error.

These specifications limit how far a golf ball will travel in several ways when hit. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and thus, a lower drag when travelling through the air. Increasing the initial velocity increases the distance the ball will travel.

The foregoing generalizations hold when the effect of size, weight, or initial velocity is measured in isolation. Flight characteristics (influenced by dimple pattern and ball rotation properties), club head speed, radius of gyration, and diverse other factors also influence the distance a ball will travel.

In the manufacture of top-grade golf balls for use by professional golfers and amateur golf enthusiasts, the distance a ball will travel when hit (hereinafter referred to as "distance") is an important design criterion. Since the U.S.G.A. rules were established, golf ball manufacturers have designed top-grade U.S.G.A. regulation balls to be as close to the maximum weight, minimum diameter, and maximum initial velocity as golf ball technology will permit. The distance a ball will travel when hit has, however, been improved by changes in raw materials and by alterations in dimple configuration.

BRIEF DESCRIPTION OF THE PRIOR ART

Golf balls not conforming in various respects to U.S.G.A. specifications have been made in the United States. Prior to the effective date of the U.S.G.A. rules, balls of various weights, diameters, and resiliencies were common. So-called "rabbit balls," which claim to exceed the U.S.G.A. initial velocity limitations, have also been offered for sale. Recently, oversized, overweight golf balls have been on sale for use as golf teaching aids (see U.S. Pat. No. 4,201,384 to Barber).

Oversized golf balls are also disclosed in New Zealand Patent 192,618 dated Jan. 1, 1980, issued to a predecessor of the present assignee. This patent discloses an oversized golf ball having a diameter between 1.700 and 1.730 inches and an oversized core of resilient material so as to increase the coefficient of restitution. Additionally, the patent discloses that the ball should include a cover having a thickness less than the cover thickness of conventional balls. The patent does not disclose any dimple size or the percentage of surface coverage by the dimples.

Golf balls made by Spalding in 1915 were of a diameter ranging from 1.630 inches to 1.710 inches. While these balls had small shallow dimples, they covered less than 50% of the surface of the ball. Additionally, as the diameter of the ball increased, the weight of the ball also increased.

Golf balls known as the LYNX JUMBO were produced and sold in October of 1979. This ball had a diameter of substantially 1.80 inches. The dimple patterns on the LYNX JUMBO balls had 336 Atti-type dimples with each dimple having a diameter of 0.147 inch and a depth of 0.0148 inch. With this dimple arrangement, 56.02% of the surface area of the ball was covered by the dimples. This ball met with little or no commercial success.

Top-grade golf balls sold in the United States may be classified as one of two types: two-piece or three-piece. The two-piece ball, exemplified by the balls sold by Spalding Corporation under the trademark TOP-FLITE, comprises a solid polymeric core and a separately formed cover. The so-called three-piece balls, exemplified by the balls sold under the trademark TITLEIST by the Acushnet Company, comprise a liquid (e.g., TITLEIST TOUR 384) or solid (e.g., TITLEIST DT) center, elastomeric thread windings about the center, and a cover. Although the nature of the cover can, in certain instances, make a significant contribution to the overall coefficient of restitution and initial velocity of a ball (see, for example, U.S. Pat. No. 3,819,768 to Molitor), the initial velocity of two-piece and three-piece balls is determined mainly by the coefficient of restitution of the core. The coefficient of restitution of the core of wound balls can be controlled within limits by regulating the winding tension and the thread and center composition. With respect to two-piece balls, the coefficient of restitution of the core is a function of the properties of the elastomer composition from which it is made. Solid cores today are typically molded using polybutadiene elastomers mixed with acrylate or methacrylate metal salts. High-density fillers such as zinc oxide are included in the core material in order to achieve the maximum U.S.G.A. weight limit.

Improvements in cover and core material formulations and changes in dimple patterns have more or less continually improved golf ball distance for the last 20 years. In co-pending application Ser. No. 08/782,221 filed Jan. 13, 1997 which is owned by the present assignee, there is disclosed a multi-layer golf ball having a diameter of generally 1.68–1.69 inches wherein one or more cover layers contains a heavy weight filler material to enhance the interior perimeter weight of the ball.

Top-grade golf balls, however, must meet several other important design criteria. To successfully compete in today's golf ball market, a golf ball should be resistant to cutting and must be finished well; it should hold a line in putting and should have good click and feel. With a well-designed ball, experienced players, can better execute shots involving draw, fade, or abrupt stops, as the situation dictates.

SUMMARY OF THE INVENTION

Accordingly, it is a primary object of the invention to provide a multi-layer golf ball including a spherical core formed of a soft compression material, a mantle layer which surrounds the core, a dimpled outer cover surrounding the mantle layer, and a heavy weight filler material arranged in at least one of the mantle and cover layers to enhance the perimeter weight of the ball. The mantle and cover layers have different Shore D hardnesses, with the hardness of the core layer preferably being less than that of the mantle layer. The ball has an outer diameter of between 1.70 and 1.76 inches, a weight no greater than 1.62 ounces, and a dimple pattern which covers at least 70% of the surface thereof.

According to a more specific object of the invention, the filler material is arranged in the mantle layer and comprises a powdered metal, preferably powdered brass.

According to another object of the invention, the mantle and cover layers are formed of an ionomer resin.

The golf ball according to the invention preferably has a core diameter of 1.50 inches, a mantle thickness of 0.050 inches, and a cover thickness of 0.055 inches, whereby the ball has a diameter of 1.71 inches.

BRIEF DESCRIPTION OF THE FIGURES

Other objects and advantages of the invention will become apparent from a study of the following specification when viewed in the light of the accompanying drawing, in which:

FIG. 1 illustrates a partially broken-away view of the improved golf ball of the present invention;

FIG. 2 illustrates dimple diameter and depth measurements; and

DETAILED DESCRIPTION

Figure 3:
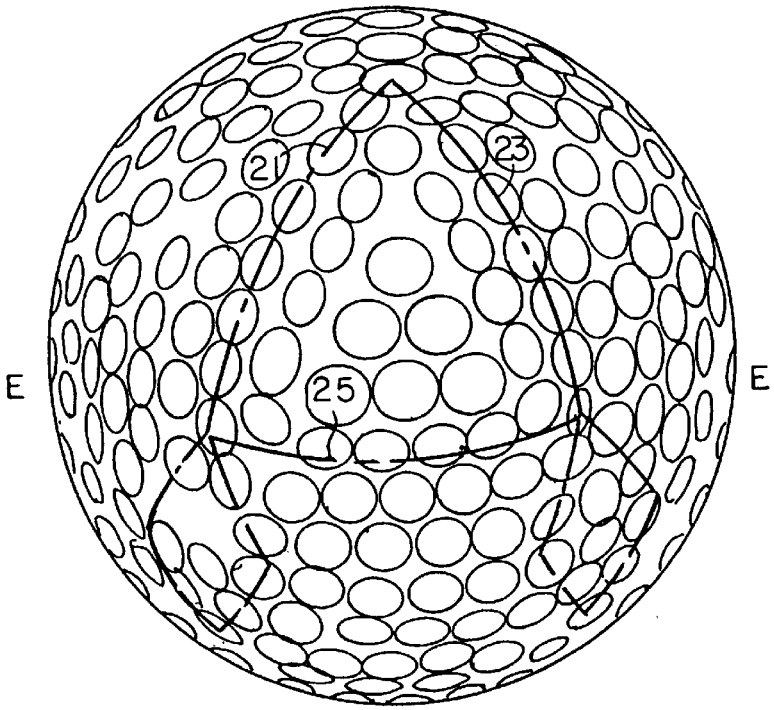
FIGS. 3, 4 and 5 disclose different dimple patterns, respectively, which may be used with the present invention.

There is shown in FIG. 1 the basic construction of a multi-layer golf ball according to the invention. The ball 11 has a core 13 surrounded by a mantle layer 15 and an outer cover layer 17 which includes a plurality of dimples 19 about its surface area.

According to a first embodiment, the mantle layer is formed of a hard ionomer or other hard polymer having a Shore D hardness of about 65 or more and the cover layer is formed of a soft ionomer or other elastomer having a Shore D hardness of about 60 or less. The multi-layer balls having inner (mantle) and outer cover layers exhibit high coefficient of restitution (C.O.R.) values and have a greater travel distance in comparison to balls made with a single cover layer.

Moreover, the softer outer layer adds to the desirable "feel" and high spin rate of the struck ball while maintaining respectable resiliency. The soft outer layer allows the cover to deform more during impact and increases the area of contact between the face of a golf club and the ball cover, thereby imparting more spin on the ball. As a result, the soft cover provides the ball with a balata-like feel and playability characteristics with improved distance and durability.

The ball of the first embodiment has a diameter D of at least 1.70", and the diameter of the core C is between 1.20 and 1.660 inches. The thickness of the mantle layer TM is between 0.020 and 0.250 inches and the thickness of the outer cover layer TC is also between 0.020 and 0.250 inches.

In a second embodiment, the mantle layer is formed from an ionomer which is softer than the outer cover layer 17 and has a Shore D hardness of 65 or less, preferably between 10 and 60 and most preferably between 30 and 60. The outer cover layer is formed of an ionomer having a Shore D hardness of about 60 or more, preferably between 65 and 80, and most preferably between 65 and 75. The golf ball of the second embodiment has a relatively low PGA compression of less than 90 and preferably 80 or less. It has good travel distance characteristics and a low spin rate by virtue of the combination of a hard core layer and a soft core and mantle layer. In this embodiment, the diameter of the core C is preferably between 1.20 inches and 1.60 inches, the thickness of the mantle layer TM is preferably between 0.020 inches and 0.250 inches as is the thickness of the outer cover layer TC.

In order to enhance the internal perimeter weight of the golf ball, a heavy weight filler material is added to at least one of the mantle and cover layers according to a third embodiment of the invention. In order to prevent the weight of the ball from exceeding 1.620 ounces, the core is formed of a lighter soft compression material. A suitable material is a diene polymer.

The heavy weight filler material is a powdered metal selected from the group of powdered brass, tungsten, titanium, bismuth, boron, bronze, cobalt, copper, inconnel metal, iron, molybdenum, nickel, stainless steel, zirconium oxide, and aluminum.

The mantle layer is preferably formed of a material with a Shore D hardness of at least 65. Suitable materials include an ionomer resin, a polyamide, a polyurethane, a polyphylene oxide, and a polycarbonate.

The cover layer is preferably formed of a material with a Shore D hardness of less than 65. Suitable materials include an ionomer resin, a thermoplastic elastomer, a thermosetting elastomer, a polyurethane, a polyester, and a polyester amide.

Preferably, the core has a diameter of 1.50 inches, the mantle layer has a thickness of 0.050 and the cover layer has a thickness of 0.055 inches, resulting in a ball having a diameter of 1.710 inches. Slight variation, in core diameter and in the thickness of the mantle and cover layers will result in a ball having a diameter of between 1.70 and 1.76 inches.

Although the heavy weight filler material can be provided in one or both of the mantle and cover layers, there are some benefits to including it in the mantle layer. One benefit is that the mantle layer is harder than the cover layer, and the addition of powdered metal such as powdered brass to the mantle layer will not diminish the softness of the cover. Another benefit is that providing the filler in the mantle will not discolor the cover. If the filler is provided in the cover layer, it is necessary to paint the ball to the desired color since the filler will discolor the cover layer material.

Set forth in the following tables are two different examples of the construction details for two multi-layer golf balls according to the third embodiment of the invention.

TABLE 1

| | Core Details | |
|---|---|---|
| | Example 1 | Example 2 |
| Ingredients | phr | phr |
| Cariflex 1220 | 70 | 70 |
| Taktene 220 | 30 | 30 |
| ZDA | 20.5 | 19.5 |
| Zinc Oxide | 6 | 17 |
| Zinc Stearate | 20 | 20 |

TABLE 1-continued

| Core Details | Example 1 | Example 2 |
|---|---|---|
| TG Regrind | 10 | 10 |
| 231 XL | 0.9 | 0.9 |
| Data | | |
| Size | 1.50" | 1.50" |
| Weight (g) | 31.0 g | 32.8 g |
| Compression (Riehle) | 125 | 125 |
| COR | 775 | 768 |
| Sp. Gr. | 1.07 | 1.132 |

TABLE 2

| Mantle Details | % Acid | Type | Cation | Example 1 | Example 2 |
|---|---|---|---|---|---|
| Materials | | | | phr | phr |
| Iotek 1002 | 18% | AA | Na | 50 | 50 |
| Surlyn 7311 | 15% | MA | Mg | 50 | 50 |
| S. Steel Power | — | — | — | 30 | 0 |
| Data | | | | | |
| Size | | | | 1.60" | 1.60" |
| Thickness | | | | 0.050" | 0.050" |
| Sp. Gr. | | | | 1.18 | 0.97 |
| Weight | | | | 36.5 g | 36.5 g |
| Compression (Riehle) | | | | 95 | 95 |
| COR | | | | 802 | 803 |
| Shore C/D | | | | 97/71 | 97/71 |

TABLE 3

| Final Ball Details | % Acid | Type | Cation | Example 1 | Example 2 |
|---|---|---|---|---|---|
| Materials | | | | phr | phr |
| Surlyn 9910 | 15% | MA | Zn | 49.1 | 49.1 |
| Surlyn 8940 | 15% | MA | Na | 16.5 | 16.5 |
| Surlyn 8120 | 7% | MA | Na | 17.5 | 17.5 |
| Surlyn 8320 | 7% | MA | Na | 7.5 | 7.5 |
| TG White MB *1 | 15% | AA | Zn | 9.4 | 9.4 |
| *1 contains 75% Iotek 7030 | | | | | |
| Final Ball Data | | | | | |
| Size | | | | 1.71" | 1.71" |
| Cover Thickness | | | | 0.055" | 0.055" |
| Sp. Gr. | | | | 0.98 | 0.98 |
| Weight | | | | 45.5 g | 45.5 g |
| Compression (Riehle) | | | | 85 | 85 |
| COR | | | | 805 | 801 |
| Shore C/D | | | | 91/62 | 91/62 |

The balls of the above examples have improved playability characteristics and enhanced interior perimeter weighting. The heavy weight filler and smaller core produces a greater moment of inertia resulting in less initial spin, but greater spin retention, reduced slicing and hooking, and increased distance. The balls also have the same "feel" as softer balata covered balls.

In all of the golf ball embodiments described above, the balls have a weight no greater than 1.62 ounces. Also, the recited dimensions are all subject to a manufacturing tolerances of ±0.05%

Referring now to FIG. 3, there is shown a ball having the enlarged dimensions of the present invention and having a dimple pattern including 422 dimples, which includes dimples of three different diameters and depths measured in accordance with FIG. 2. As indicated in FIG. 3, the largest dimple 33 diameter is 0.169 inch with a dimple depth of 0.0123 inch, the intermediate dimple 35 diameter is 0.157 inch with a dimple depth of 0.0123 inch, and the smallest dimple 31 diameter is 0.145 inch with a dimple depth of 0.0101 inch. With the pattern shown, the resultant weighted average dimple diameter is 0.1478 inch and the weighted average dimple depth is 0.0104 inch. With this configuration and dimple size, 78.4% of the surface area of the ball is covered by dimples without any dimple overlap. The ball of FIG. 3 includes repeating patterns bounded by lines 21, 23 and 25 about each hemisphere, with the hemispheres being identical. One such pattern in shown in FIG. 4, which indicates the arrangement of dimples and the relative sizes of the dimples in that particular pattern.

Figure 4:
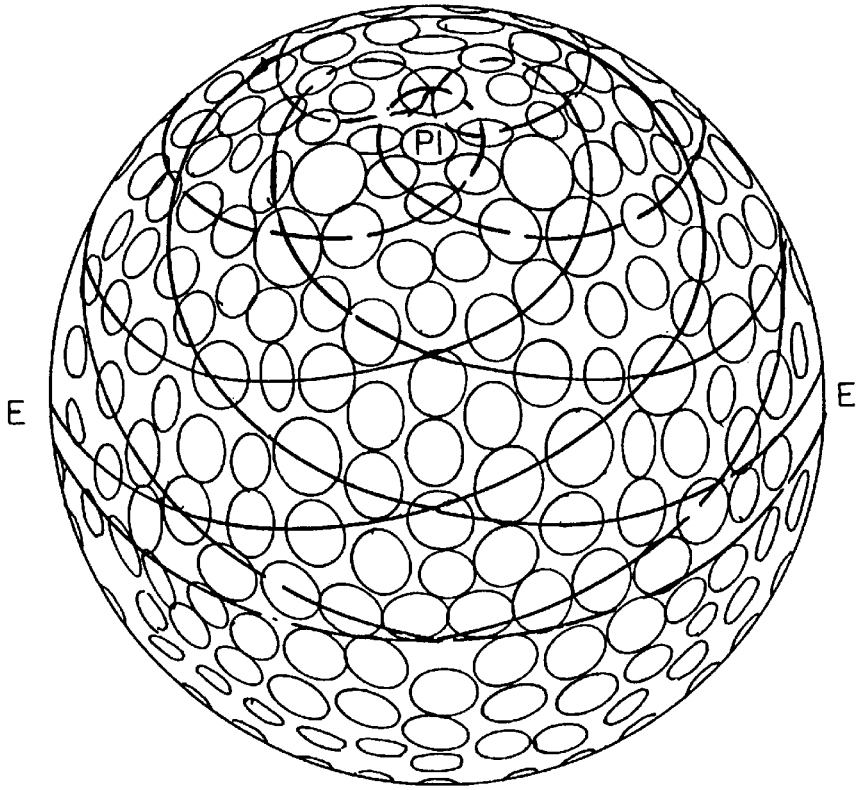

A further modification is shown in FIG. 4. This golf ball has 410 dimples comprising 138 dimples having a diameter of 0.169 inch and a depth of 0.0116 inch, 160 dimples having a diameter of 0.143 inch and a depth of 0.0101 inch, and 112 dimples having a diameter of 0.112 inch and a depth of 0.0077 inch. The configuration of the dimples comprises a dimple-free equatorial line E—E dividing the ball into two hemispheres having substantially identical dimple patterns. The dimple pattern of each hemisphere comprises a first plurality of dimples extending in four spaced clockwise arcs between the pole and the equator of each hemisphere, a second plurality of dimples extending in four spaced counterclockwise arcs between the pole and equator of each hemisphere, and a third plurality of dimples filling the surface area between the first and second plurality of dimples. In this ball, none of the dimples overlap. This pattern provides a weighted average dimple diameter of 0.1433 inch, a weighted average dimple depth of 0.010 inch, and a 73.1% coverage of the surface of the ball.

Figure 5:
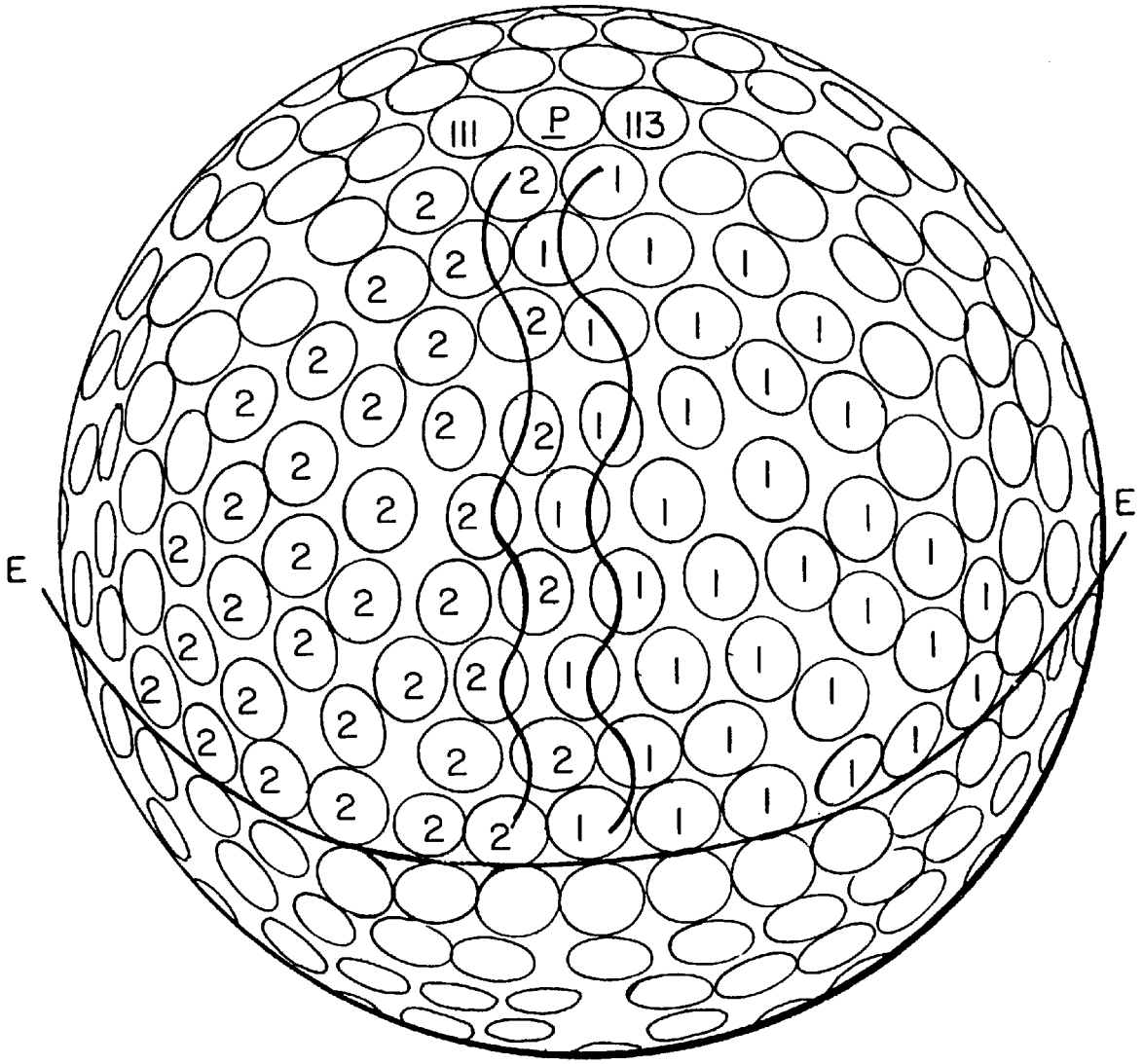

A still further modification is shown in FIG. 5. This golf ball has 422 dimples, all dimples having the same diameter of 0.143 inch and the same depth of 0.0103 inch. The dimples are arranged in a configuration so as to provide a dimple-free equatorial line, with each hemisphere of the ball having six identical dimpled substantially mating sections with a common dimple at each pole. FIG. 5 shows two mating sections having dimples 1 and 2, respectively. Each section comprises six dimples lying substantially along a line parallel with but spaced from the equatorial line, 29 dimples between the six dimples and the common polar dimple, with the outer dimples of each of the sections lying on modified sinusoidal lines 111 and 113.

Since only one diameter is used for all dimples, some small percentage of overlap occurs in order to provide substantial surface coverage with the dimples. For this particular pattern, there is an 11.4% (48) dimple overlap with a 73.2% coverage of the surface are of the ball. Overlap is determined by finding the number of dimples having an edge overlapping any other dimple and dividing that number by the total number of dimples on the ball, such number being expressed as a percentage.

In addition to the advantages discussed above, there is easier access to the ball with the club in both the fairway and rough because of the ball's size. This easier access allows for cleaner hits. Further, the increased size and moment results in the ball's ability to hold the line during putting. Thus, by increasing the percentage of dimple coverage of the surface of the ball, the ball has the advantages attributable to the larger ball while having enhanced flight characteristics as compared to previous balls having enlarged diameters.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A multi-layer golf ball, comprising (a) a spherical core formed of a soft compression material;

(b) a mantle layer surrounding said core;

(c) a dimpled outer cover layer surrounding said mantle layer and having a different Shore D hardness than said mantle layer; and (d) at least one of said mantle and cover layers including a filler material having a weight greater than said core material to enhance the perimeter weight of the ball, the ball having an outer diameter of between 1.70 and 1.76 inches (43.2–44.7 mm) and a weight no greater than 1.62 ounces (45.93 g).

2. A multi-layer golf ball as defined in claim 1, wherein said filler material is a powdered metal selected from the group consisting of powdered brass, tungsten, titanium, bismuth, boron, bronze, cobalt, copper, inconnel metal, iron, molybdenum, nickel, stainless steel, zirconium oxide, and aluminum.

3. A multi-layer golf ball as defined in claim 2, wherein said mantle layer is comprised of a material selected from the group consisting of an ionomer resin, a polyamide, a polyurethane, a polyphylene oxide, and a polycarbonate.

4. A multi-layer golf ball as defined in claim 3, wherein said outer cover layer is comprised of a material selected from the group consisting of an ionomer resin, a thermoplastic elastomer, a thermosetting elastomer, a polyurethane, a polyester and a polyester amide.

5. A multi-layer golf ball as defined in claim 4, wherein said filler material is arranged in said mantle layer.

6. A multi-layer golf ball as defined in claim 4, wherein said filler material is arranged in said cover layer.

7. A multi-layer golf ball as defined in claim 5, wherein said mantle layer has a Shore D hardness of at least 65 and said outer cover layer has a Shore D hardness of less than 65.

8. A multi-layer golf ball as defined in claim 7, wherein the dimples in said outer cover layer are arranged in a pattern covering at least 70% of the surface of the ball.

9. A multi-layer golf ball as defined in claim 2 wherein said mantle layer has a thickness of 0.020–0.250 inches (0.508–6.35 mm) and said outer layer has a thickness of 0.020–0.250 inches (0.508–6.35 mm).

10. A multi-layer golf ball as defined in claim 9, wherein said core has a diameter of generally 1.50 inches.

11. A multi-layer golf ball as defined in claim 10, wherein the ball has an outer diameter of 1.71 inches (43.40 mm).

* * * * *